United States Patent [19]

Aileo et al.

[11] Patent Number: 4,847,920

[45] Date of Patent: Jul. 18, 1989

[54] DUAL-VISOR ASSEMBLY FOR HELMET

[75] Inventors: Jackson A. Aileo, Carbondale; Richard J. Long, Lake Ariel; Joseph J. Zaccone; James J. Petruzella, both of Carbondale, all of Pa.

[73] Assignee: Gentex Corporation, Carbondale, Pa.

[21] Appl. No.: 45,410

[22] Filed: May 4, 1987

[51] Int. Cl.[4] ..... A42B 1/08; A42B 3/00; F41H 1/04

[52] U.S. Cl. ..... 2/424; 2/6; 2/10

[58] Field of Search ..... 2/6, 9, 10, 410, 422, 2/424

[56] References Cited

U.S. PATENT DOCUMENTS

| | | | |
|---|---|---|---|
| 2,903,700 | 9/1959 | Finken et al. | 2/10 |
| 3,491,372 | 1/1970 | Aileo | 2/9 |
| 4,047,249 | 9/1977 | Booth | 2/424 X |
| 4,138,746 | 2/1979 | Bergmann | 2/424 |
| 4,621,377 | 11/1986 | Pennell | 2/6 |

FOREIGN PATENT DOCUMENTS

| | | | |
|---|---|---|---|
| 1561660 | 2/1980 | United Kingdom | 2/6 |

OTHER PUBLICATIONS

Gentex Corporation, "HGU-55/P U.S. Air Force Fighter/Attack Aircrew Helmet", (12/1982).

Gentex Corporation, "PRU-36/P Side Actuated Dual Visor Kit Assembly", (12/1983).

*Primary Examiner*—Thomas R. Hannon

*Attorney, Agent, or Firm*—Shenier & O'Connor

[57] ABSTRACT

A dual-visor assembly for use with a helmet such as that of an aircraft crew member in which an inner visor is releasably secured to the helmet by snap fasteners that release toward the rear of the helmet, while an outer visor is releasably secured to the helmet over the inner visor by snap fasteners that release toward the front of the helmet to prevent the inadvertent release of both visors simultaneously. The snap fasteners are carried by straps that are secured to the inner surface of the inner visor and to the outer surface of the outer visor to prevent entanglement. Elements carried by the visors space the inner visor from the outer visor as well as from the surface of the helmet. A soft cover is releasably secured over the outer visor in its raised position to prevent scratching of the outer visor or other structures.

29 Claims, 5 Drawing Sheets

Fig 1
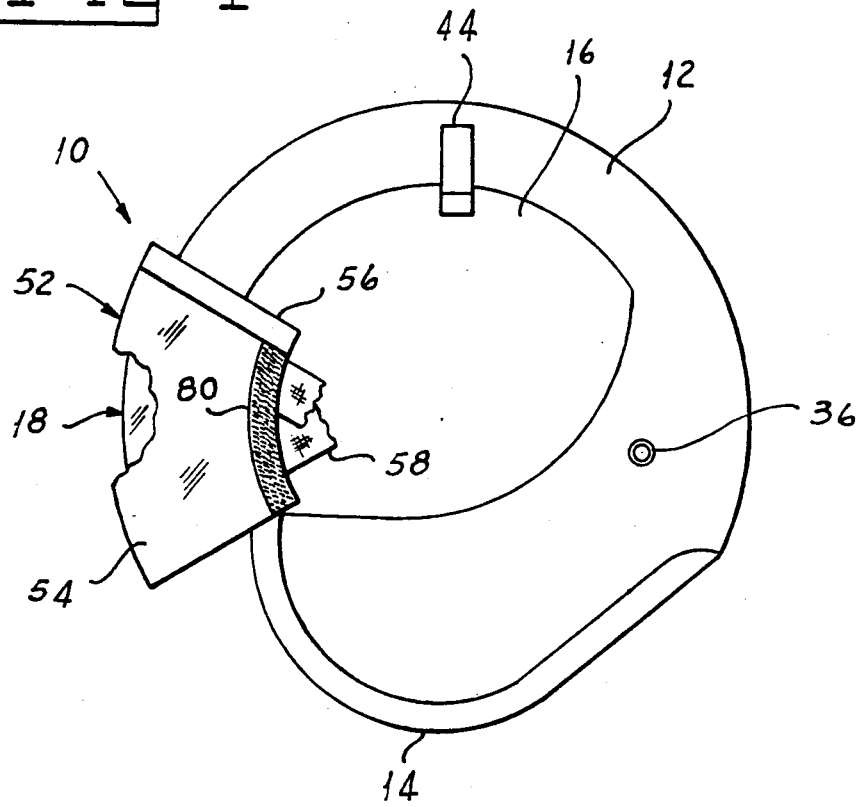
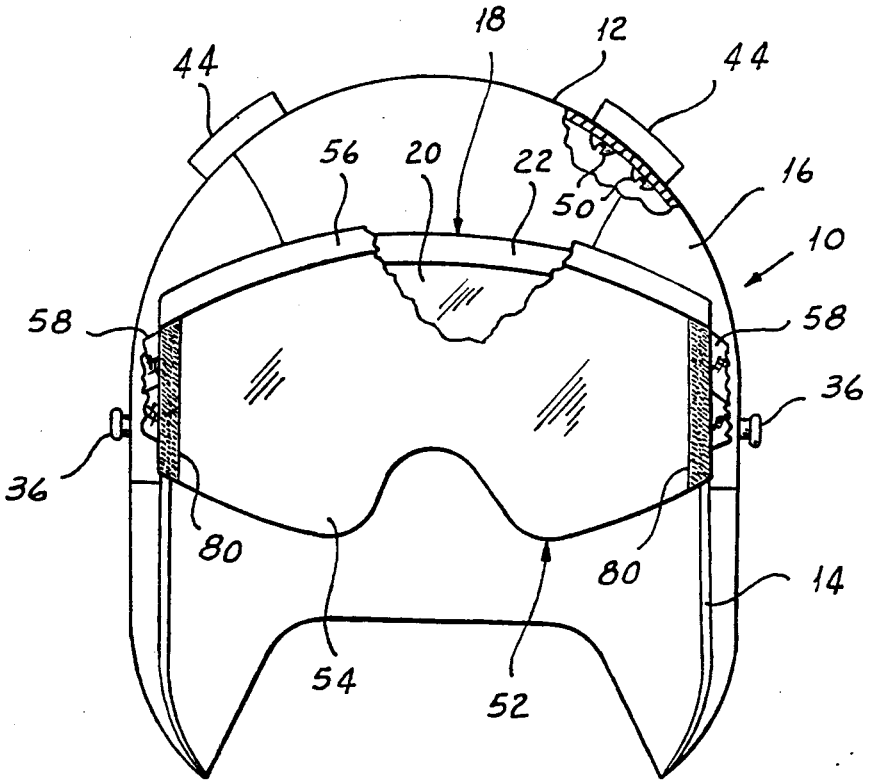
Fig 2

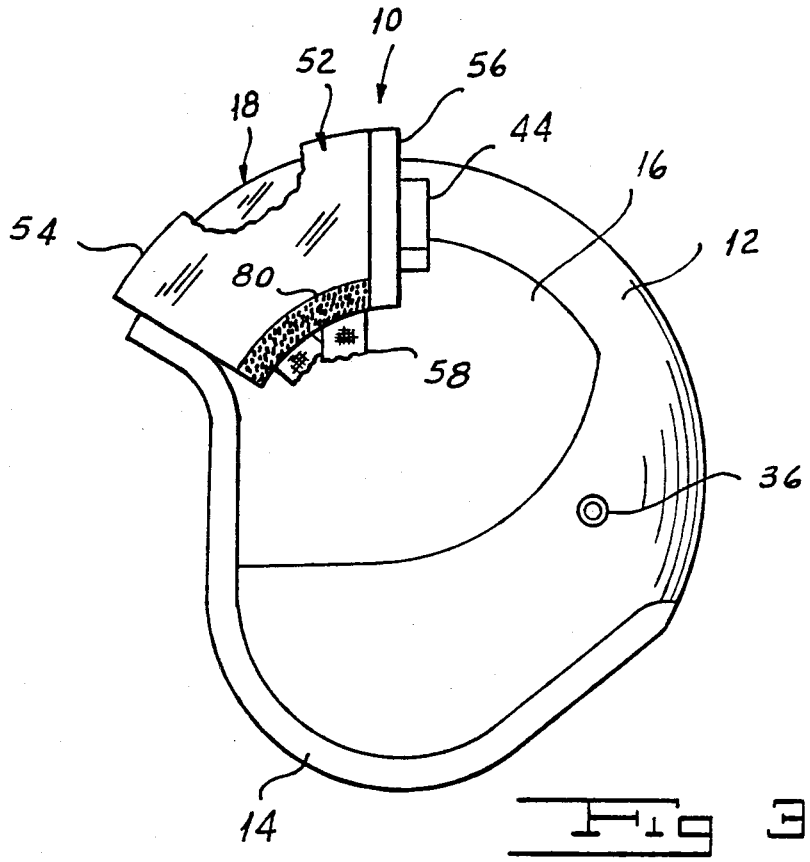
FIG 3
FIG 4
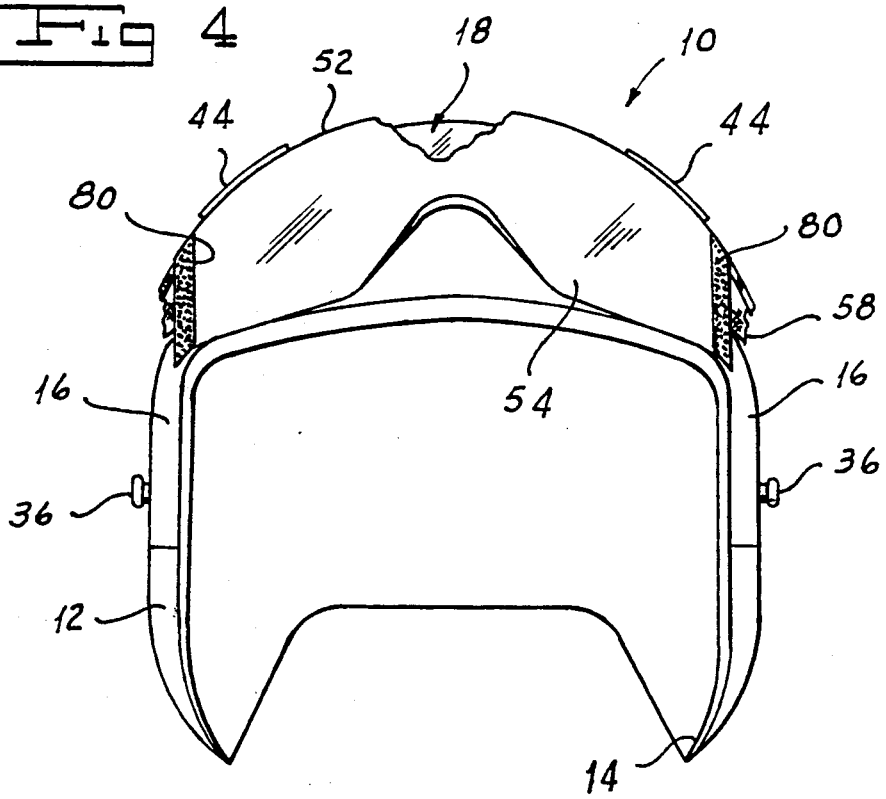

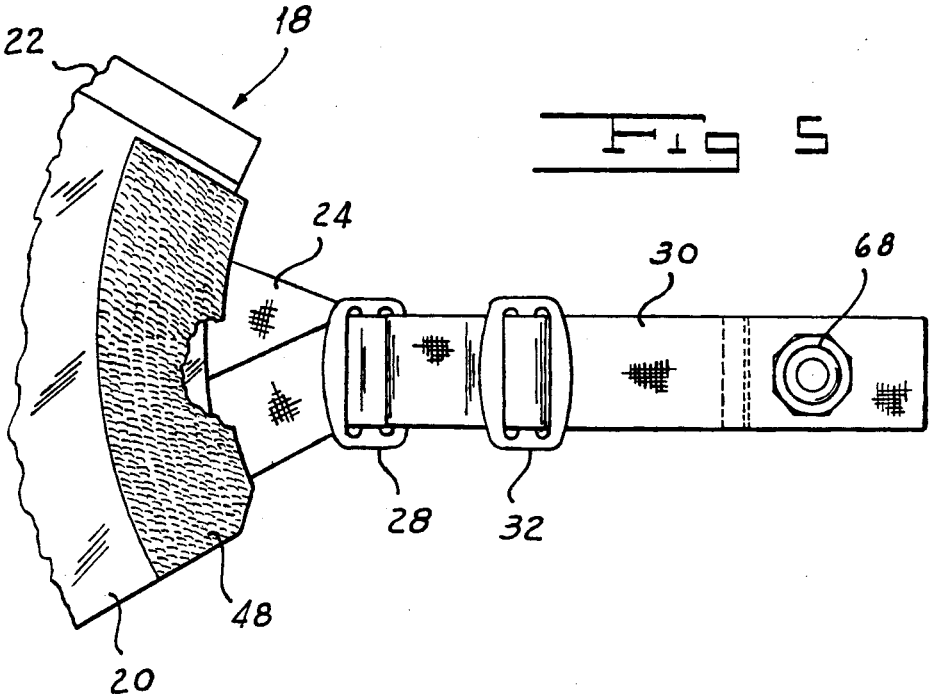
Fig 5
Fig 6
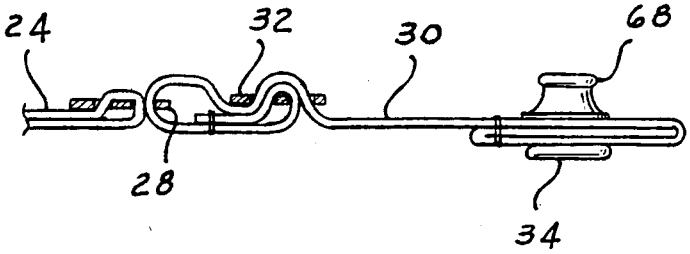
Fig 7
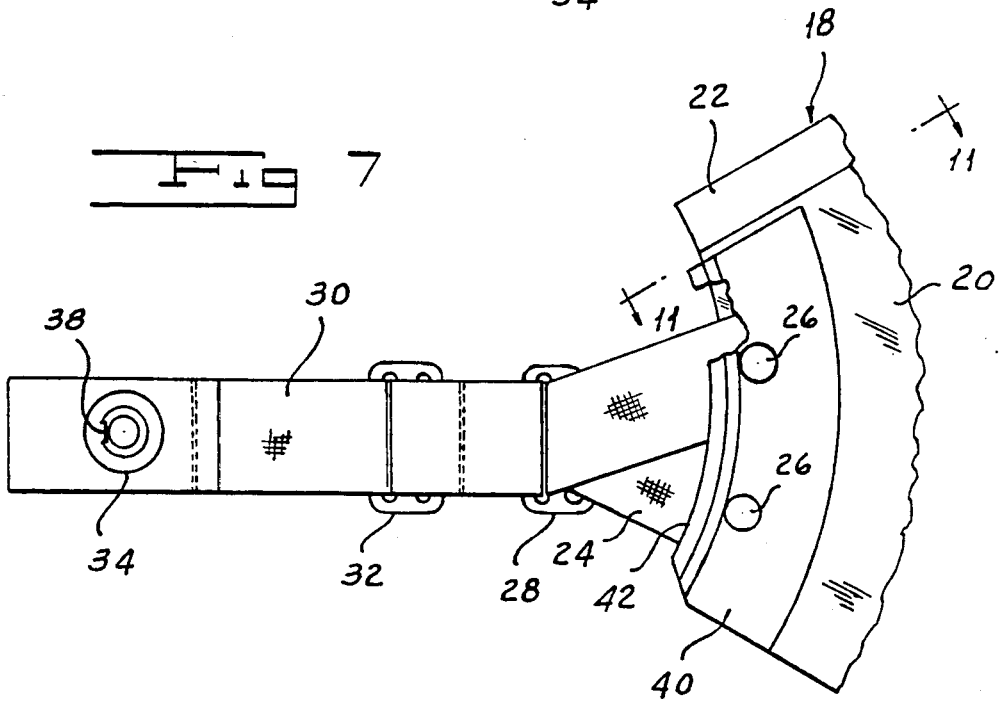

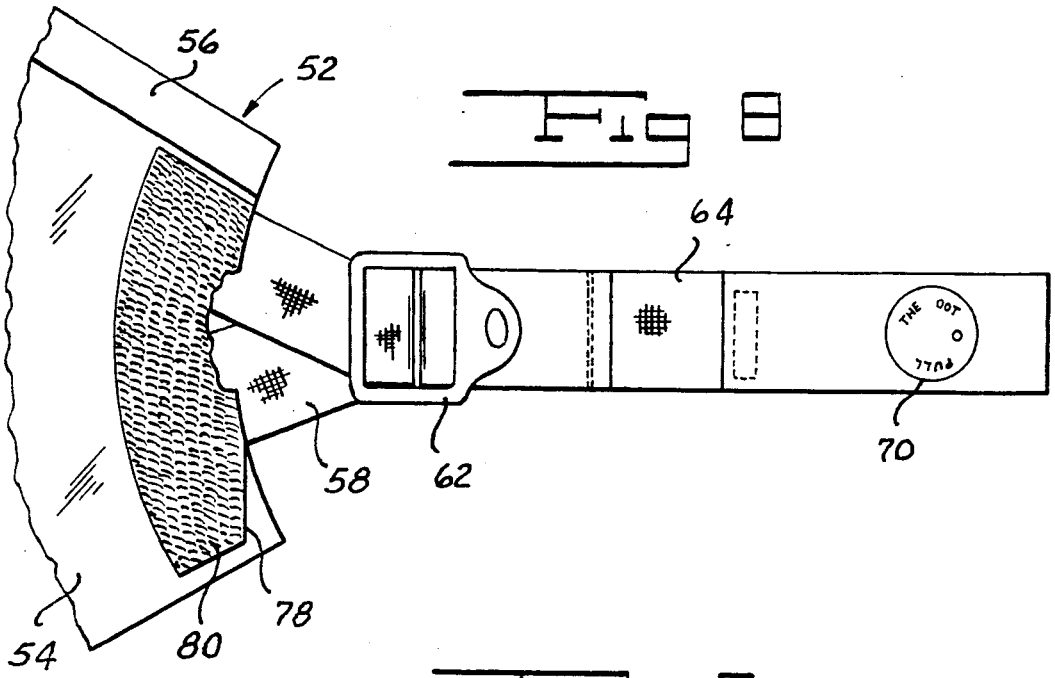
Fig 8
Fig 9
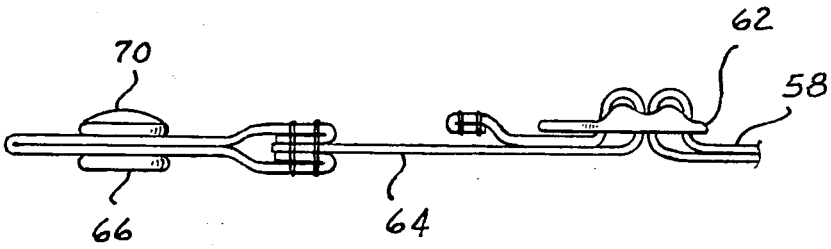
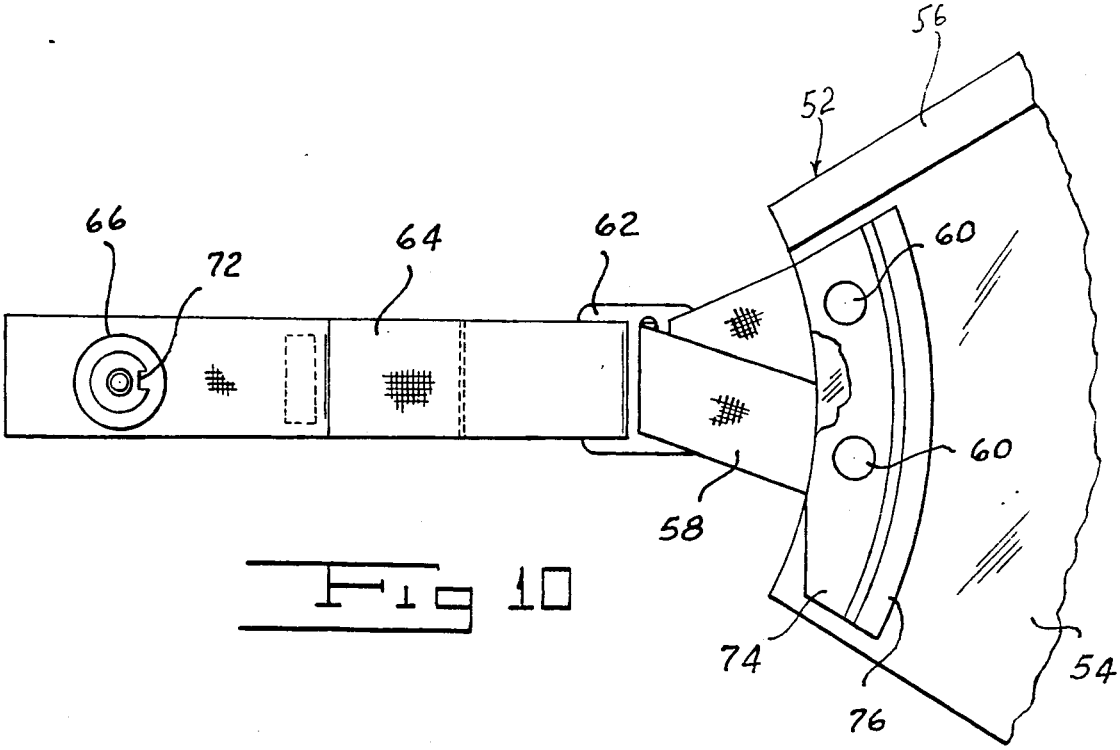
Fig 10

Fig 11
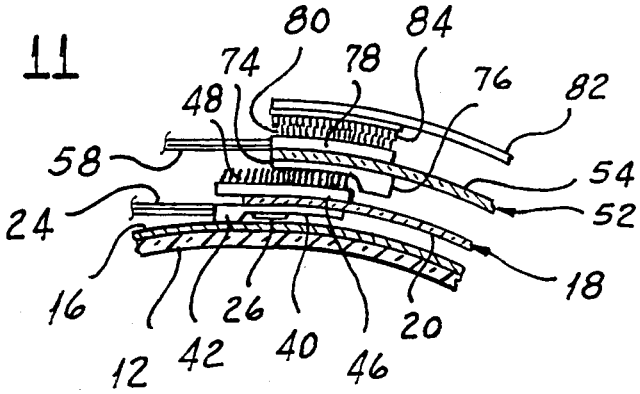
Fig 12
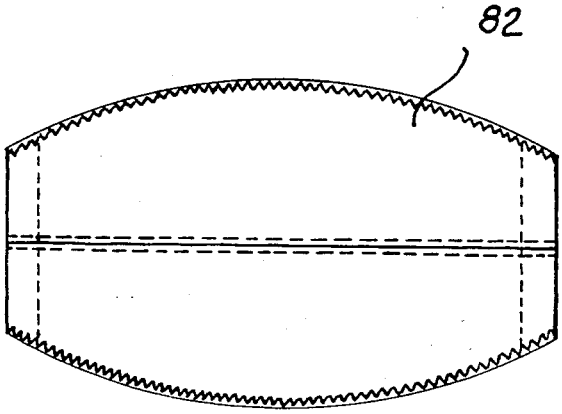
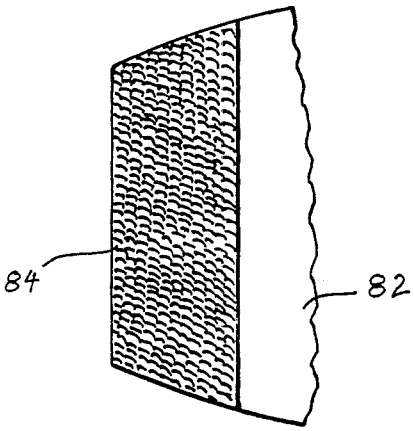
Fig 13

DUAL-VISOR ASSEMBLY FOR HELMET

BACKGROUND OF THE INVENTION

Our invention relates to a dual-visor assembly for use with a helmet such as that worn by a crew member of a military aircraft.

Dual-visor assemblies for helmets are known in the art. In one such assembly, an inner visor and an outer visor are received for independent sliding movement along tracks in a housing outboard of the helmet shell between lowered positions in front of the wearer's face and raised positions clear of the wearer's face. Such an assembly has an appreciable weight, which is undesirably concentrated near the front of the helmet. In addition, the housing cover reduces the wearer's peripheral vision, particularly at the ten o'clock, twelve o'clock and two o'clock positions. Finally, the housing cover and the screws used in its assembly may scratch the aircraft canopy.

SUMMARY OF THE INVENTION

One of the objects of our invention is to provide a dual-visor assembly that is relatively lightweight.

Another object of our invention is to provide a visor assembly in which the weight is not concentrated toward the front of the helmet.

Still another object of our invention is to provide a visor assembly that does not impair peripheral vision.

A further object of our invention is to provide a visor assembly that will not injure the canopy of an aircraft or other enclosure.

Other and further objects will be apparent from the following description.

In general, our invention contemplates a dual-visor assembly for use with a helmet in which an inner visor is releasably secured to the helmet and an outer visor is releasably secured to the helmet over the inner visor, preferably by releasably securing the outer visor to the inner visor. Preferably, the inner visor is secured to the helmet by snap fastener elements that release toward the rear of the helmet, while the outer visor is secured to the inner visor by snap fastener elements that release toward the front of the helmet to prevent the inadvertent release of both visors simultaneously. Preferably, the snap fastener elements are carried by straps that are secured to the inner surface of the inner visor and to the outer surface of the outer visor to prevent the straps from becoming entangled. Preferably, the visors also carry spacer elements that space the inner visor from the outer visor as well as from the surface of the helmet.

BRIEF DESCRIPTION OF THE DRAWINGS

In the drawings, which form part of the instant specification and which are to be read in conjunction therewith:

FIG. 1 is a left side elevation, with parts broken away, of our dual-visor assembly with the visor cover removed and the visors in a lowered position.

FIG. 2 is a front elevation, with parts broken away, of the visor assembly of FIG. 1 with the visor cover removed and the visors in a lowered position.

FIG. 3 is a left side elevation, with parts broken away, of the visor assembly of FIG. 1 with the visor cover removed and the visors in a raised position.

FIG. 4 is a front elevation, with parts broken away, of the visor assembly of FIG. 1 with the visor cover removed and the visors in a raised position.

FIG. 5 is a fragmentary left side elevation of the inner visor of the visor assembly of FIG. 1.

FIG. 6 is a fragmentary bottom plan of the left strap of the inner visor shown in FIG. 5.

FIG. 7 is a fragmentary right side elevation of the inner visor of the assembly shown in FIG. 1, with parts broken away.

FIG. 8 is a fragmentary left side elevation of the outer visor of the assembly shown in FIG. 1, with parts broken away.

FIG. 9 is a fragmentary top plan of the left strap of the visor shown in FIG. 8.

FIG. 10 is a fragmentary right side elevation of the visor shown in FIG. 8, with parts broken away.

FIG. 11 is a fragmentary section, taken along line 11—11 of FIG. 7, of the visors in an assembled position over the helmet shell with the visor cover attached.

FIG. 12 is a front elevation of the visor cover of the assembly shown in FIG. 1.

FIG. 13 is an enlarged fragmentary rear elevation of the visor cover shown in FIG. 12.

DESCRIPTION OF THE PREFERRED EMBODIMENT

Referring now to FIGS. 1 to 4, our dual-visor assembly, indicated generally by the reference numeral 10, is used in conjunction with a rigid helmet shell 12 having a compliant edge guard 14 along its periphery. Assembly 10 may be manufactured as an original part of the helmet 12 or, if desired, may be manufactured separately as a kit for use with existing helmets. Shell 12 may be formed of any suitable material, such as fiberglass fabric molded with epoxy resin. Shell 12 includes a suitable inner liner, such as the liner shown in U.S. Pat. No. 4,432,099, as well as a chin strap (not shown) for releasably retaining the shell on the wearer's head. In addition to wearing the helmet 12, the wearer will also typically be wearing a breathing mask (not shown). Scuff guards 16 of any suitable material such as leather extend over the temple areas of the shell to protect the shell from abrasive contact with the visors of the assembly 10.

An inner visor indicated generally by the reference numeral 18 is secured to the shell 12 for movement between a lowered position, shown in FIGS. 1 and 2, in front of the wearer's face, and a raised position, shown in FIGS. 3 and 4, over the shell 12 clear of the wearer's face. Referring now also to FIGS. 5 to 7, inner vision 18 includes a transparent lens portion 20 formed of any suitable plastic material, preferably polycarbonate. Respective right and left elastic straps 30 carrying female snap fasteners 34 releasably secure the inner visor 18 to respective male fasteners 36 (FIGS. 1 to 4) carried on the sides of helmet shell 12. Except for the modification to be described below, fasteners 34 and 36 are of the conventional type in which the circumferentially outwardly extending lip of the male fastener element is pushed through the smaller-diameter opening defined by the circumferentially inwardly extending lip of the female fastener element to secure the two elements and is pulled out of the same opening to release the two elements. Any suitable means, such as a screw, washer and nut (not shown) may be used to secure fasteners 36 to shell 12.

Referring now particularly to FIGS. 5 to 7, a buckle 28 receiving a portion of strap 30 on each side of the visor 18 also receives a V-shaped strap section 24, the ends of which are secured to the inner surface of visor lens 20 by rivets 26. A second buckle 32 receiving a looped end portion of strap 30 also receives an intermediate portion of the strap 30, as shown in FIGS. 5 to 7, to permit adjustment of the tension of strap 30. Referring to FIG. 7, the circumferentially inwardly projecting lip of the female snap fastener element 34 carried by strap 30 is provided with an inwardly projecting tap or "flat" 38 at the rear thereof. Flat 38 entraps the adjacent outwardly projecting lip portion of the corresponding male fastener element 36 on the shell 12 to permit the fastener element 34 to be released from fastener element 36 only upon outward pulling movement exerted on the strap 30 forwardly of fastener elements 34 and 36. Stated somewhat differently, snap fastener element 34 releases from element 36 toward the rear of the helmet shell 12.

Respective spacer elements 40 carried on the inner surface along the side edges of visor 18 space the lens portion 20 of inner visor 18 from the adjacent surface of helmet shell 12 to prevent possible abrasion of the inner lens surface. Spacers 40 may be formed of any suitable material, such as produced by vacuum forming 0.060 inch thick sheets of the material sold under the trademark Cycolac. As shown in FIGS. 1 to 4 and 11, spacers 40 rest upon the scuff guards 16 of helmet shell 12. Referring now particularly to FIG. 11, spacers 40 preferably have inwardly projecting portions 42 along their outboard edges to avoid abrasive contact between rivets 26 and scuff guards 16 or helmet shell 12. Respective stops 44 carried near the top of helmet shell 12 on the left and right sides define an upper limit position for the inner visor 18, shown in FIGS. 3 and 4. As shown in FIG. 2, respective pairs of screws 50 extending upwardly from the underside of shell 12 secure stops 44 to the shell. Stops 44 are mounted so that the lower edges of visors 18 and 52 are approximately flush with the edge guard 14 in their raised positions shown in FIGS. 3 and 4. If desired, a suitable template (not shown) may be placed along the upper edge of visor 18 to facilitate proper location of the holes (not shown) in shell 12 for screws 50. Preferably, visor lens 20 includes a top edge guard 22 to protect the lens from injurious contact with the stops 44 or other objects.

Referring again to FIGS. 1 to 4, an outer visor indicated generally by the reference numeral 52 is releasably secured to the inner visor 18, and hence to the shell 12, in a manner to be described for movement between a lowered position shown in FIGS. 1 and 2 and a raised position shown in FIGURES 3 and 4 in a fashion similar to that of inner visor 18. Outer visor 52 includes a transparent lens portion 54 which, like lens portion 20, is formed of a suitable plastic material, preferably polycarbonate. In the particular embodiment shown, the lens portion 20 of inner visor 18 is clear, whereas the lens 54 of outer visor 52 is tinted a neutral gray to attenuate incident light and othe radiation. Lens portion 54 carries a top edge guard 56 similar to top edge guard 22. Referring now also to FIGS. 8 to 10, respective left and right elastic straps 64 carrying female snap fasteners 66 releasably secure the outer visor 52 to respective male fasteners 68 (FIGS. 5 to 7), similar to fasteners 36, carried by inner visor straps 30 outwardly of and coaxially with fasteners 34. Outer visor straps 64 are in turn provided with respective outer covers 70 opposite fastener elements 66.

In a manner similar to that of inner visor 18, a buckle 62 receiving a portion of strap 64 on each side of the visor 52 also receives a V-shaped straps section 58, the ends of which are secured to the outer surface of visor lens 54 by rivets 60. The end of each strap 64 remote from fastener 66 may be stitched to an intermediate section of the strap 64, as shown in FIG. 9, or may remain free to permit adjustment of the tension of strap 64. Referring to FIG. 10, the female snap fastener 66 carried by each strap 64 is provided with a flat 72 at the front thereof in a manner similar to that of fastener 38.

Flat 72 cooperates with the corresponding male fastener 68 of the inner visor strap 30 to permit the fastener 66 to be replaced from fastener 68 only upon outward pulling movement exerted on the strap 64 rearwardly of fasteners 66 and 68. Stated somewhat differently, snap fastener 66 releases from fastener 68 toward the front of helmet shell 12. To assist the wearer in this respect, the cover 70 associated with snap fastener element 66 may, as shown in FIG. 8, be formed with a dot toward the rear thereof along with a notation, such as "Pull the Dot", reminding the wearer of the correct manner in which to separate the two fasteners 66 and 68. Respective spacer elements 74 carried on the inner surface of visor 52 along the side edges space the lens portion 54 of outer visor 52 from the outer surface of lens portion 20 of inner visor 18. Referring now to FIG. 11, spacers 74 rest upon respective pile fabric layers 48 carried by strips 46 adhered to the outer surface of inner visor lens 20. In a manner similar to that of spacers 40, spacers 74 preferably have inwardly projecting portions 76 along their inboard edges to provide a seat for the pile fabric portions 48 of inner visor 18 as shown in FIG. 11.

Referring again to FIGS. 8 to 10, outer visor lens 54 also carries respective strips 78 on the outer surface along the side edges. Strips 78 carry respective pile fabric layers 80 of loop fastener material. Layers 80 releasably engage complementary strips 84 of hook fastener material (such as that sold under the trademark Velcro) carried along the side edges of the inner surface of a lens cover 82, preferably formed of a soft material such as leather. In this manner, lens cover 82 may be releasably secured to the outer visor 52 to avoid abrasive contact between the outer visor and other objects.

The dual-visor assembly 10 is designed to be worn with the inner, clear visor 18 in the lowered position at all times, with the outer, tinted visor 52 being lowered as required by flight conditions or at the wearer's discretion. Preferably, the tension of the inner visor straps 30 is approximately twice that of the outer visor straps 64. This permits raising and lowering of the outer visor 52 with minimal effort and also lessens the possibility of entanglement of the straps or buckles of the inner and outer visors.

To lower visors 18 and 52 together from the raised position shown in FIGS. 3 and 4, the wearer, after removing the visor cover 82, places his fingers along the center of the top edge guards 56 and 22 and pulls the visors downwardly along the surfaces of scuff guards 16 to the lowered position shown in FIGS. 1 and 2. In this position, the lower edges of the visors firmly seat against the breathing mask (not shown) of the wearer, if present. If the use of the outer, tinted visor 52 is not required or desired, the wearer grasps the outer visor 52, preferably along both the upper and lower edges thereof. The wearer then, simultaneously with pulling the outer visor 52 outwardly, slides the outer visor relative to the inner visor 18 to the desired position in which the edge guard 56 of visor 52 abuts stops 44.

To raise both visors 18 and 52 together, the wearer grasps the visors at the top and bottom edges and, simultaneously with pulling the visors outwardly from the helmet shell 12 somewhat, slides the visors together relative to the shell to the desired raised position against stops 44, shown in FIGS. 3 and 4. If only the inner visor 18 is in the lowered position, the wearer grasps the outer visor 52 along the top and bottom edges and, simultaneously with pulling the outer visor 52 outwardly of inner visor 18, slides the outer visor to a lowered position over the inner visor 18, as shown in FIG. 2. The wearer then raises both visors 18 and 52 simultaneously to the upper position defined by limit stops 44. Upon raising the visors 18 and 52 to the limit position, the wearer may attach the lens cover 82 to protect the outer surface of visor 52.

It will be seen that we have accomplished the objects of our invention. Our dual-visor helmet assembly is relatively lightweight, and does not impair peripheral vision. Owing to the attachment to the rear of the helmet, the weight of our assembly is distributed more uniformly, and is not concentrated toward the front of the helmet. Since no screws or visor housing cover are used, the aircraft canopy has less chance of being scratched. In addition, since the inner visor releases toward the rear of the helmet while the outer visor releases toward the front, the outer visor may be removed during flight without inadvertently removing the inner visor as well.

It will be understood that certain features and subcominations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A dual-visor assembly for use with a helmet including in combination an inner visor, first means for securing said inner visor to said helmet, an outer visor, and second means including mating fasteners respectively carried by said visors for releasably securing said outer visor to said inner visor for movement independently of said inner visor between a lowered position in front of the wearer's face and a raised position clear of the wearer's face.

2. An assembly as in claim 1 in which said first securing means releases only in a predetermined direction, and second securing means releasing only in a direction opposite said predetermined direction.

3. An assembly as in claim 1 in which said first securing means includes a snap fastener carried by said inner visor and a mating snap fastener carried by said helmet.

4. An assembly as in claim 1 in which said second securing means includes mating snap fasteners respectively carried by said visors.

5. An assembly as in claim 1 in which said first securing means includes a first pair of mating fasteners carried by said helmet and said inner visor, said second securing means including a second pair of mating fasteners carried by said inner visor and said outer visor.

6. An assembly as in claim 1 in which said first securing means includes a first pair of straps carried on the inner surface of said inner visor, said second securing means including a second pair of straps carried on the outer surface of said outer visor.

7. An assembly as in claim 1 in which said visors include transparent lens portions, one of said visors including means for spacing the lens portion thereof from the lens portion of the other of said visors.

8. An assembly as in claim 1 in which said first securing means includes a first strap carried by said inner visor and a first pair of mating fasteners carried by said first strap and said helmet, said second securing means including a second strap carried by said outer visor and a second pair of mating fasteners carried by said second strap and said first strap.

9. An assembly as in claim 1 including said helmet.

10. An assembly as in claim 1 in which said first securing means releasably secures said inner visor to said helmet.

11. An assembly as in claim 1 in which said first securing means secures said inner visor to said helmet at a predetermined location on said helmet for movement of said inner visor between a lowered position in front of the wearer's face and a raised position clear of the wearer's face.

12. An assembly as in claim 11 in which said second securing means secures said outer visor to said helmet at said predetermined location.

13. An assembly as in claim 11 in which said first securing means includes a first pair of mating snap fasteners carried by said helmet and said inner visors at said location, said second securing means including a second pair of mating snap fasteners carried by said inner visor and said outer visor at said location.

14. A dual-visor assembly for use with a helmet including in combination an inner visor, first means for releasably securing said inner visor to said helmet, an outer visor, and second means for releasably securing said outer visor to said helmet over said inner visor, said first securing means releasing only in a predetermined direction, said second securing means releasing only in a direction opposite said predetermined direction.

15. An assembly as in claim 14 in which said second securing means comprises means for releasably securing said outer visor to said inner visor.

16. An assembly as in claim 14 in which said first securing means releases only toward the rear of said helmet, said second securing means releasing only toward the front of said helmet.

17. An assembly as in claim 16 in which said second securing means comprises means for releasably securing said outer visor to said inner visor.

18. An assembly as in claim 14 in which said first securing means secures said visor to said helmet at a predetermined location on said helmet, said second securing means securing said outer visor to said inner visor at said location.

19. An assembly as in claim 18 in which said first and second securing means comprises respective pairs of mating snap fasteners.

20. A dual-visor assembly for use with a helmet including in combination an inner visor, means including a first pair of straps carried on the inner surface of said inner visor for securing said inner visor to said helmet, an outer visor, and means including a second pair of straps carried on the outer surface of said outer visor for releasably securing said outer visor to said helmet over said inner visor.

21. An assembly as in claim 20 in which said first and second securing means releasably secure said visors to said helmet.

22. A dual-visor assembly for a helmet including in combination an inner visor, means including a first flexible strap carried by said inner visor and a first pair of mating fasteners carried by said first strap and said helmet for releasably securing said inner visor to said helmet, an outer visor, and means including a second flexible strap carried by said outer visor and a second pair of mating fasteners carried by said second strap and said first strap for releasably securing said outer visor to said helmet over said inner visor.

23. A dual-visor kit for use with a helmet comprising a first visor and a second visor, each of said visors comprising a transparent lens portion having left and right sides and a pair of straps extending from said sides, each of the straps of said first visor having a first fastener for releasably securing said visor to said helmet and a second fastener on the other side of said strap from said first fastener, each of the straps of said second visor having a third fastener adapted to mate with one of said second fasteners.

24. A kit as in claim 23 in which said second fastener in in registry with said first fastener.

25. A kit as in claim 23 in which said second fastener is complementary to said first fastener.

26. A kit as in claim 23 which said first fastener is so formed as to release from said helmet only in a predetermined direction, said third fastener releasing from said second fastener only in a direction opposite said predetermined direction.

27. A kit as in claim 23 in which said fasteners are snap fasteners.

28. A dual-visor kit for use with a helmet comprising a first visor and a second visor, said first visor having a first fastener for releasably securing said visor to said helmet and a second fastener opposite said first fastener, said second visor having a third fastener adapted to mate with said second fastener, said first fastener being so formed as to release from said helmet only in a predetermined direction, said third fastener releasing from said second fastener only in a direction opposite said predetermined direction.

29. A kit as in claim 28 in which said fasteners are snap fasteners.

* * * * *